US006202432B1

(12) United States Patent
Haasis

(10) Patent No.: US 6,202,432 B1
(45) Date of Patent: Mar. 20, 2001

(54) FOOD QUALITY ENHANCING REFRIGERATION SYSTEM

(75) Inventor: Hans Haasis, Goleta, CA (US)

(73) Assignee: Omnitemp Industries, Inc., Downey, CA (US)

( * ) Notice: Subject to any disclaimer, the term of this patent is extended or adjusted under 35 U.S.C. 154(b) by 0 days.

(21) Appl. No.: 09/397,954

(22) Filed: Sep. 17, 1999

Related U.S. Application Data

(63) Continuation of application No. 09/126,900, filed on Jul. 31, 1998, now Pat. No. 6,000,236.

(51) Int. Cl.[7] ..... F25D 23/12
(52) U.S. Cl. ..... 62/258; 62/440; 62/446
(58) Field of Search ..... 62/440, 258, 446

(56) References Cited

U.S. PATENT DOCUMENTS

| | | |
|---|---|---|
| 0,985,620 | 2/1911 | Monette . |
| 2,305,319 | 12/1942 | Pirnie . |
| 2,322,882 | 6/1943 | Raskin . |
| 2,407,159 | 9/1946 | Jones . |
| 2,438,355 | 3/1948 | Wilson . |
| 2,504,217 | 4/1950 | Nelson et al. . |
| 2,660,864 | 12/1953 | Morris . |
| 2,890,863 | 6/1959 | Scal . |
| 3,364,694 | 1/1968 | Cohen et al. . |
| 4,802,340 | 2/1989 | Johnson . |
| 5,168,719 | 12/1992 | Branz et al. . |
| 5,191,769 | 3/1993 | Mangini et al. . |
| 5,247,807 | 9/1993 | Jarman et al. . |
| 5,277,039 | 1/1994 | Haasis . |
| 5,363,672 | 11/1994 | Moore et al. . |
| 5,381,672 | 1/1995 | Haasis . |
| 5,388,429 | 2/1995 | Shackelford et al. . |
| 5,722,254 | 3/1998 | Roth et al. . |
| 6,000,236 * | 12/1999 | Haasis ..... 62/440 |

* cited by examiner

*Primary Examiner*—William Doerrler
*Assistant Examiner*—Mark Shulman
(74) *Attorney, Agent, or Firm*—Oppenheimer Wolff & Donnelly LLP

(57) ABSTRACT

A refrigerated food pan assembly is disclosed which includes food pans which rest within an inner channel through a mounting lip. The assembly includes an outer channel separated from the inner channel by insulation. Refrigeration coils are in thermal conduction with the inner channel to cool food kept within the food pans. A cold air plenum with outlet vents extends along the inner channel to blow cold air toward and between the food pans. Fan arrangements draw cold air through louvers from within the inner channel and direct the cold air into the plenum. An upper refrigeration coil provides additional cooling to the top surface of food in the food pans, and a warming coil may also be provided to prevent the rim or lip of the outer channel from accumulating frost.

18 Claims, 4 Drawing Sheets

FIG. 4
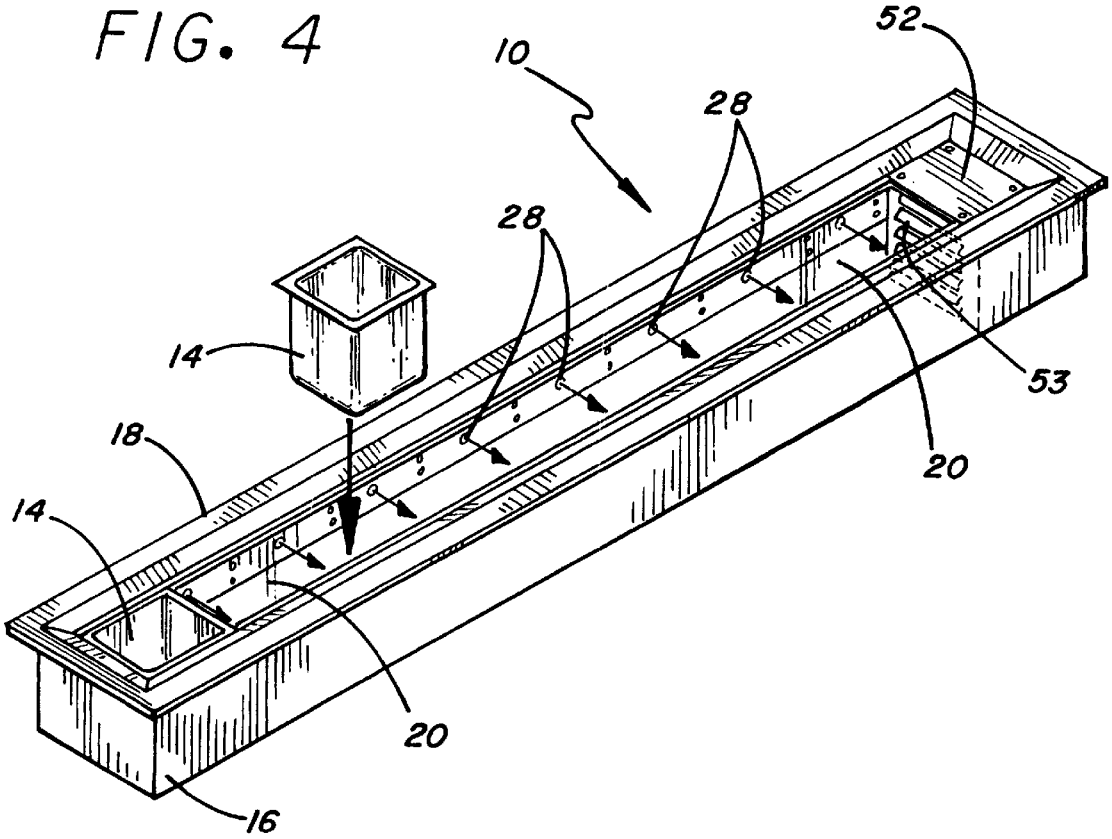
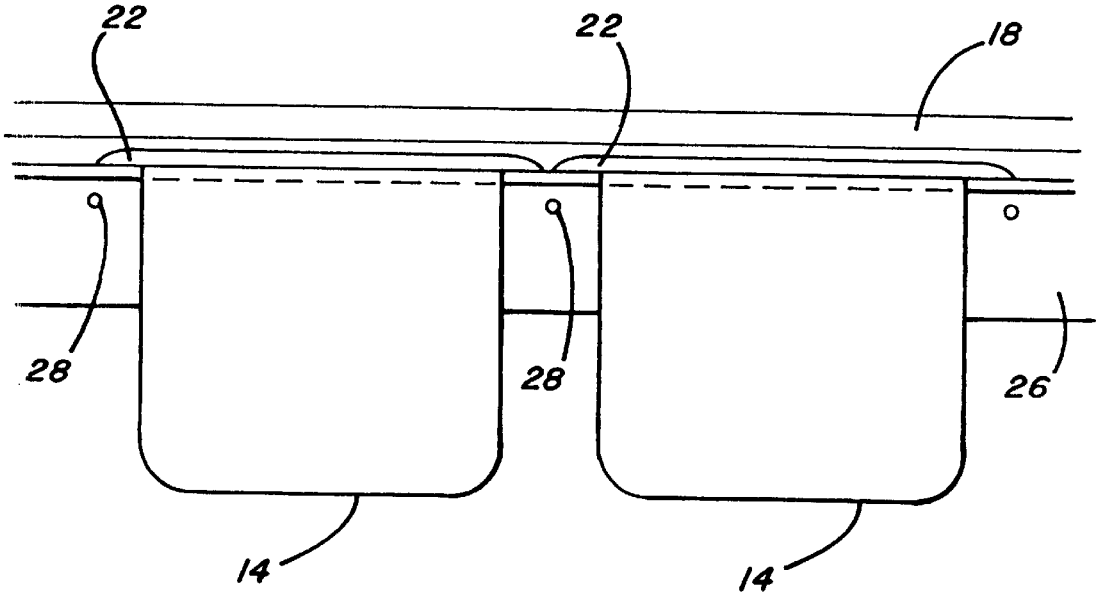
FIG. 5

FOOD QUALITY ENHANCING REFRIGERATION SYSTEM

RELATED APPLICATION

This application relates to and is a continuation of application Ser. No. 09/126,900 filed Jul. 31, 1998, now U.S. Pat. No. 6,000,236, granted Dec. 14, 1999 and the contents thereof are incorporated by reference herein.

FIELD OF THE INVENTION

The present invention relates generally to refrigeration systems and, more particularly, to countertop food pan refrigeration systems.

BACKGROUND OF THE INVENTION

Prior art refrigeration units for use with cabinet or countertop food preparation are well known in the art. Typical patents include U.S. Pat. No. 5,363,672 issued on Nov. 15, 1994, U.S. Pat. No. 5,388,429 issued on Feb. 14, 1995, U.S. Pat. No. 5,355,687 issued on Oct. 18, 1994, U.S. Pat. No. 5,277,039 issued on Jan. 11, 1994, and U.S. Pat. No. 5,381,672 issued on Jan. 17, 1995. However, problems associated with food preparation refrigeration units continue to exist. Such problems include failing to adequately cool all the regions of the food contained in the food pans. Several patents disclose food pan arrangements with cooling coils in the units and cold air circulation around open top food pans.

Since the top portion of food in an open top food pan is exposed to the ambient air temperature and typically is furthest from the cooling zones, this portion of the food is more susceptible to spoiling. Prior patents addressing this problem often used evaporators in close proximity to the food pans and often added an upper cooling zone. Some prior patents attempted to cool the top portion of food in the pans by blowing cold air directly across the food in a standard compression refrigeration system. However, prior refrigeration units for use in countertop food preparation do not adequately cool the top portion of the food without drying it or causing frost to accumulate near the upper edges of the refrigeration unit.

Accordingly, it is an object of the present invention to provide a countertop food preparation refrigeration unit which provides additional cooling to the top layer of food in the food pan to prevent this food from spoiling due to exposure to the ambient air temperature. Additional objects of the invention are to prevent frost from accumulating on the outside rim near the food pans and to avoid drying out the food. Thus, an overall object of the present invention is to provide a simple and economical refrigeration unit for a countertop food preparation assembly embodying these features.

SUMMARY OF THE INVENTION

In accordance with one specific illustrative embodiment of the present invention, a refrigeration unit is adapted for use with a countertop in a countertop food preparation assembly.

According to one aspect of the invention there is provided a refrigerated food pan assembly which comprises an elongated inner channel with inner walls and a base. There is an elongated outer channel extending around said inner channel. Refrigeration coils are in thermal conduction with the inner channel for cooling the space within the inner channel. The coils are located around the inner walls and the base of the inner channel.

A plurality of food pans are mounted into the inner channel, and spaced apart from one another and from the inner walls of said inner channel.

In a broader aspect of the present invention, a cold air plenum is provided to blow cold air into a channel which holds food pans. The plenum includes vent openings to direct cold air near the top part of the food pans. By directing the cold air near the top of the food pans, the top layer of food is kept colder.

In another broad aspect of the present invention, an upper cooling coil provides a stationary blanket of cold air just above the top of the food pan to supply additional cooling to the top layer of food. Additionally, a warming arrangement may be mounted near the top and outer rim or lip of the outer channel. The warming arrangement prevents the outside rim or lip of the assembly from accumulating frost. Thus, the upper cooling coil properly maintains the coolness of the top layer of food without drying it while the warming arrangement serves to prevent frost from accumulating on the outside rim or lip.

Other objects, features and advantages of the invention will become readily apparent upon reference to the following detailed description when considered in conjunction with the accompanying drawings, in which like reference numerals designate like parts throughout the figures thereof.

BRIEF DESCRIPTION OF THE DRAWINGS

FIG. 4 is a perspective view of the refrigerated food pan assembly showing the outlet vents of the plenum along the inner channel of the assembly to blow cold air between the food pans;

FIG. 5 is a schematic cross-sectional front view of the food pans with mounting lips and includes the outlet vents shown in FIG. 4;

DETAILED DESCRIPTION OF THE PREFERRED EMBODIMENTS

Figure 1:
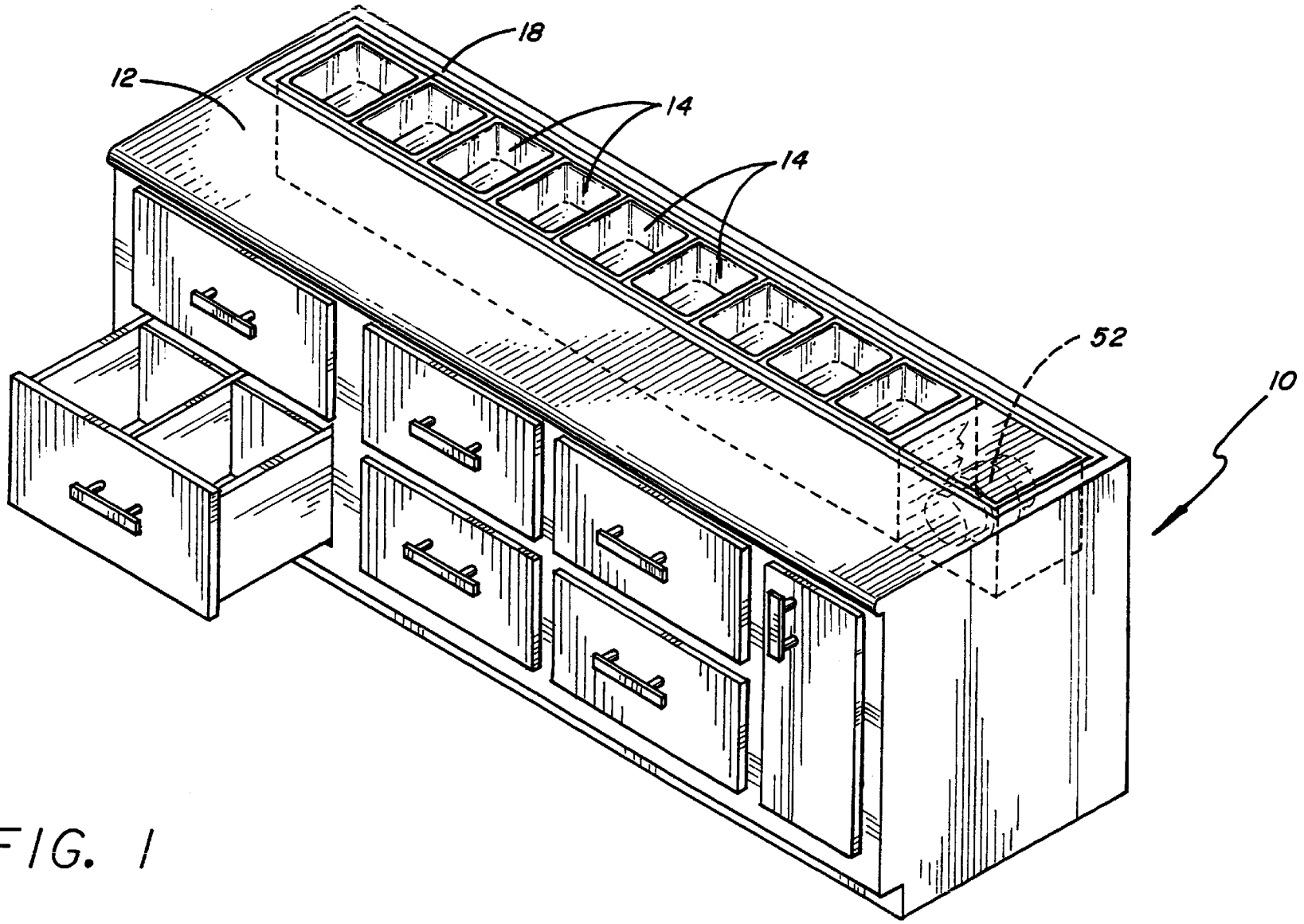
FIG. 1 is a perspective view of a refrigerated food pan assembly illustrating the present invention recessed within a cabinet which provides storage area below the assembly.

FIG. 1 illustrates a specific embodiment of a refrigerated food pan assembly 10 which includes a counter 12 for serving food from multiple food pans 14 mountable along an elongated metallic channel 16. The assembly includes an outer channel 16 with a peripheral rim or lip 18 adaptable to allow the assembly 10 to be mounted in a recess within the counter 12. Alternatively, the assembly 10 may be mounted on top of a counter or table.

Figure 2:
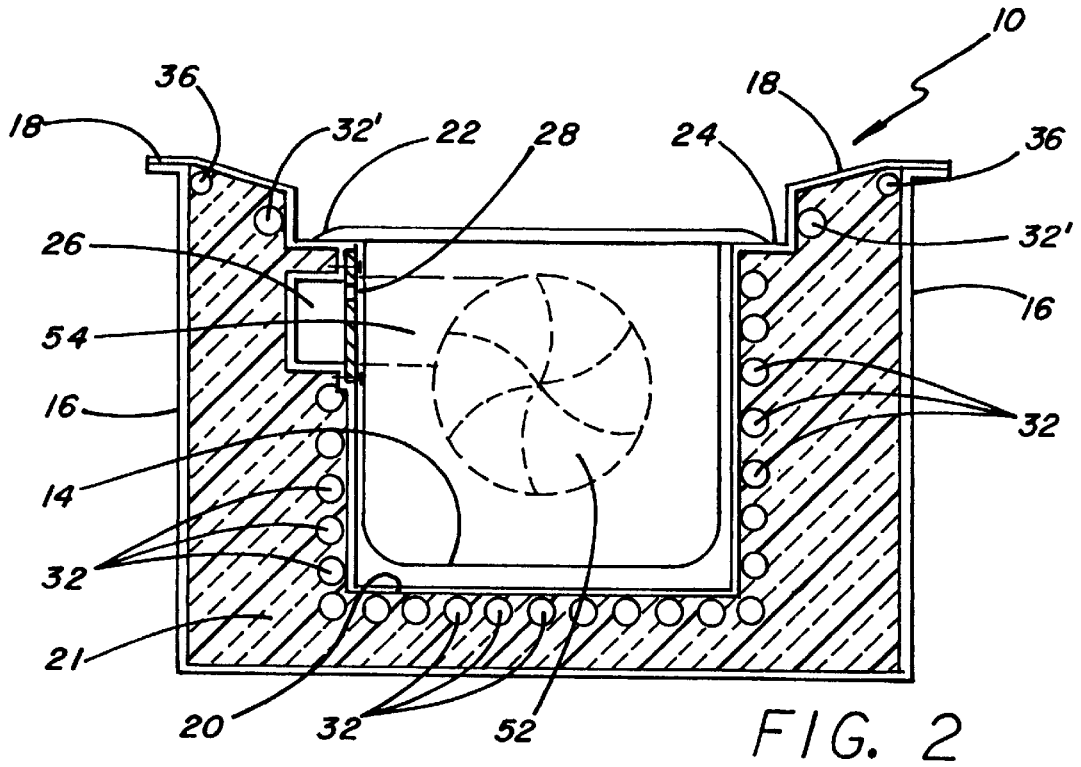
FIG. 2 is a cross-sectional side view of an exemplary preferred embodiment of the refrigerated food pan assembly of the present invention.

FIG. 2 shows several key aspects of the present invention through a cross sectional view of a refrigerated food pan assembly 10. A food pan 14 is mounted within an inner channel 20 with space provided between the inner channel 20 and the food pan 14. The inner channel 20 is spaced from an outer channel 16, and foamed-in-place insulation 21 fills the intervening space. The food pan 14 includes a mounting lip 22 which allows the food pan 14 to rest within the inner channel 20 with the lip 22 engaging a shoulder 24 on the inner channel 20. A manifold or plenum 26 is shown including an air vent 28 which blows cold air between the food pans 14 directed at the top portion of the food pan 14. Several refrigeration coils 32 are mounted in thermally conducting engagement with the inner metallic channel 20 to keep the zone within the channel 20, including the food pans 14, cool.

Additionally, FIG. 2 shows an upper refrigeration coil 32' mounted at an elevation slightly above the upper surface of the food pan 14 between the rim or lip 18 of the outer channel 16 and the shoulder 24 of the inner channel 20. The upper refrigeration coil 32' provides a blanket of cold air above the upper surface of the food pan 14 to provide extra cooling to the top layer of food in the food pan 14 without drying out the food. Further, a warming coil 36 is mounted near the peripheral rim or lip 18 of the outer channel 16 to prevent frost from accumulating on the rim or lip 18 of the outer channel 16.

In early tests of the invention without the warming coil 36, ice and frost formed on the rim or lip 18 of the outer channel 16. The ice formed as a result of the exposure of the cold rim or lip 18 to the humid air often present in food service areas. The ice melted after the refrigeration unit 10 was no longer powered.

To prevent the problems resulting from this frost build-up, a warming coil 36 was added near the peripheral rim or lip 18 of the outer channel 16. The warming coil 36 functions in a so-called "sub-cooling" process while warming the outer edge of the rim or lip 18. The term "sub-cooling" is employed as this coil 36 removes heat from the coolant within the refrigeration coils 32. The warming coil 36 is spaced back near the outer edge of the lip or rim 18 so that it does not interfere with the upper refrigeration coil 32' which supplies the blanket of cold air to the upper surface of food within the food pans 14. Therefore, the warming coil 36, acting with the upper refrigeration coil 32', function to provide the proper amount of refrigerated cold air to prevent premature spoiling of the top surface of food without drying the food or exposing the assembly 10 to run-off water.

Figure 3:
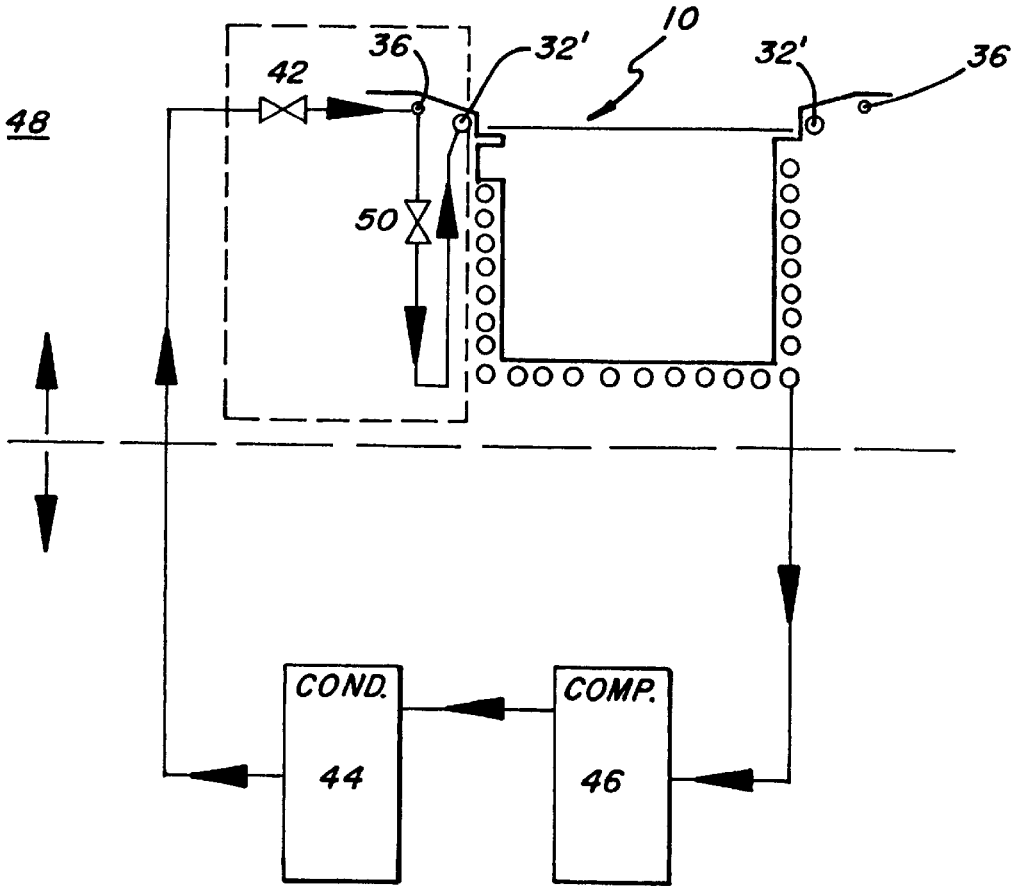
FIG. 3 is a schematic diagram of a refrigeration system for the food pan assembly, including a compressor, a condenser, and associated valves as required for a compression refrigeration system.

A compression refrigeration system 48 is shown in FIG. 3 and includes a solenoid valve 42, an expansion valve 50, a condenser 44, a compressor 46 and the preferred embodiment of the refrigerated food pan assembly 10. A cooling material, such as freeon or similar coolant, flows within the compression refrigeration system 48 in a closed loop. Warmed coolant exiting the refrigeration assembly 10 enters the compressor 46 where the temperature of the coolant significantly increases; typically to a temperature of about 215° F. The coolant is then fed into the condenser 44 which converts it from a gaseous to a liquid state while reducing the temperature of the coolant to about 95–105° F. The liquid coolant exits the condenser 44 to be circulated through a solenoid valve 42, a sub-cooling or warming coil 36, and an expansion valve 50.

The solenoid valve 42 interacts with a thermostat to control the flow of the coolant. The temperature of the coolant entering the sub-cooling or warming coil 36 is about 100° F., so the warming coil 36 both warms the rim or lip 18, and further removes heat from the coolant before it enters the expansion valve 50. The warming coil 36 in its function of warming the rim or lip 18 of the outer channel 16 prevents the formation of frost or ice on the rim or lip 18. Before the coolant enters the refrigeration assembly 10, the expansion valve 50 permits the liquid coolant to expand into a gaseous state. As it passes through the expansion valve 50, the temperature of the coolant is drastically reduced to about 5–10° F., and the coolant is then fed into the refrigeration assembly 10. After the coolant exits the refrigeration assembly 10, it enters the compressor 46 where the closed loop refrigeration process is repeated.

FIGS. 1, 2, 4, 6, and 7 show a fan arrangement including a fan 52 which draws cold air from within the inner channel 20 through vents or louvers 53 and directs it through a duct 54 into a plenum 26. A metallic cover 55 protects the fan 52 from the environment but is removable via recessed screws in order to service the fan 52. The plenum 26 extends substantially along the inner channel 20 and uses vent openings 28 to direct cold air between the food pans 14. Additionally, a metallic plate 29 which covers the plenum 26 and which includes the vent openings 28 may be removed via recessed screws for servicing or cleaning the plenum 26.

For embodiments utilizing larger food pans 14 an additional duct 54' and an additional plenum 26', with an additional set of outlet vents, may be added. The duct 54' and plenum 26', with an additional set of outlet vents, may be located along the other elongated side of the inner channel 20 to increase the amount of cold air directed to cool the food pans 14.

FIG. 5 shows a schematic cross-sectional front view of the food pans 14 with mounting lips 22 and outlet vents 28 of the plenum 26. The food pans 14 of one embodiment have a side length of six inches and width also equal to six inches. However, for some applications, a width of up to 12 inches and a length of up to 30 inches could be employed. With larger pans 14 of this type, two plenums 26 and 26' would be preferred for additional cooling.

In conclusion, it is to be understood that the foregoing descriptions and accompanying drawings relate to only some of the preferred embodiments. Other embodiments may be utilized without departing from the spirit and scope of the invention.

Concerning the construction of the channel 20, any geometry which serves to effectively and efficiently cool the space between the channel 20 and the pans 14 may be used. Thus, by way of example and not of limitation, the refrigeration coils 32 themselves may be bonded together and form the inner wall of the channel 20. Alternatively, the function of the entire assembly 10, including the inner and outer channels 20 and 16 and the refrigeration coils 32, may be implemented by a plastic molded channel shaped configuration with the refrigeration coils 32 located along the inner wall of the molded plastic channel, with no separate metallic inner and outer channels 20 and 16.

The refrigerated food pan assembly 10 could use an absorption, compression or other type of refrigeration system. Also, the inner channel 20 and outer channel 16 of the assembly 10 are preferably formed from stainless steel. However, the outer channel 16 may alternatively be formed from galvanized steel, plastic or another suitable material. Further, foamed-in-place insulation 21 is preferably used between the inner 20 and outer channel 16, although other types of insulation could be used. The rim or lip 18 of the outer channel 16 may be angled upward and then flatten out as shown in FIGS. 2, 4, and 5, or the rim or lip 18 may extend directly outward from the inner channel 20.

Figure 6:
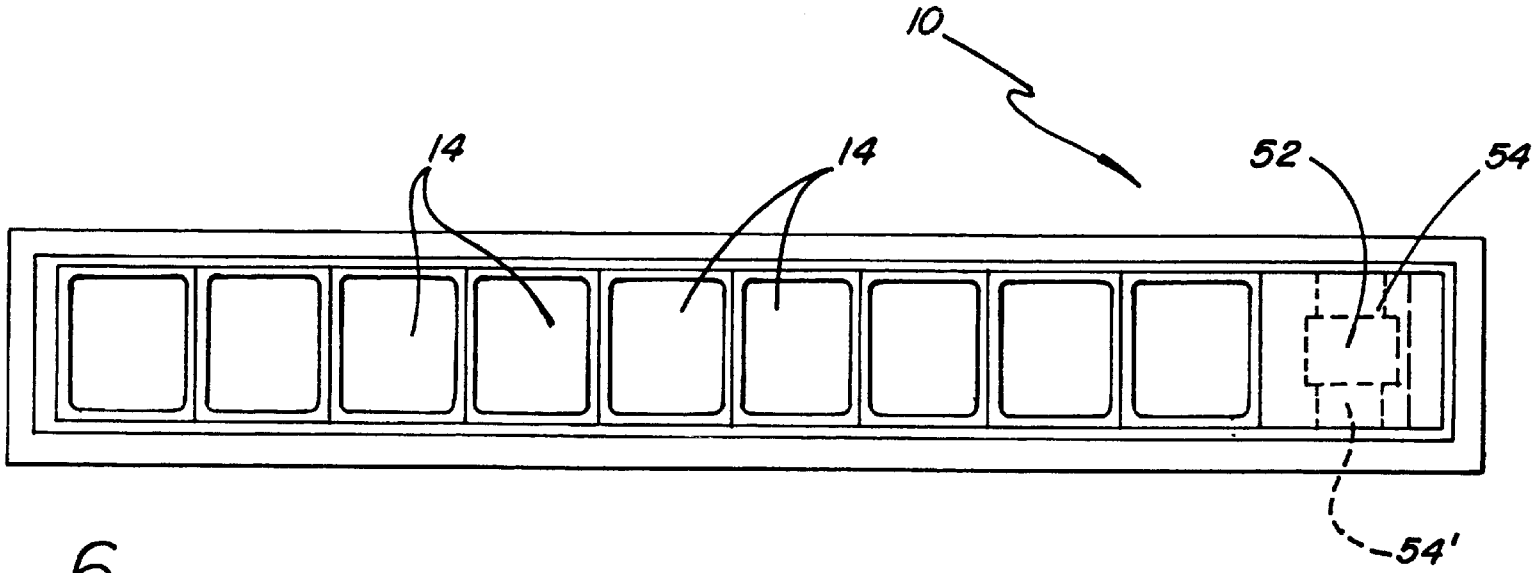
FIG. 6 is a top view of the assembly, showing food pans mounted within the inner channel, and the outer channel extending around the inner channel with a peripheral lip to mount on a counter.
Figure 7:
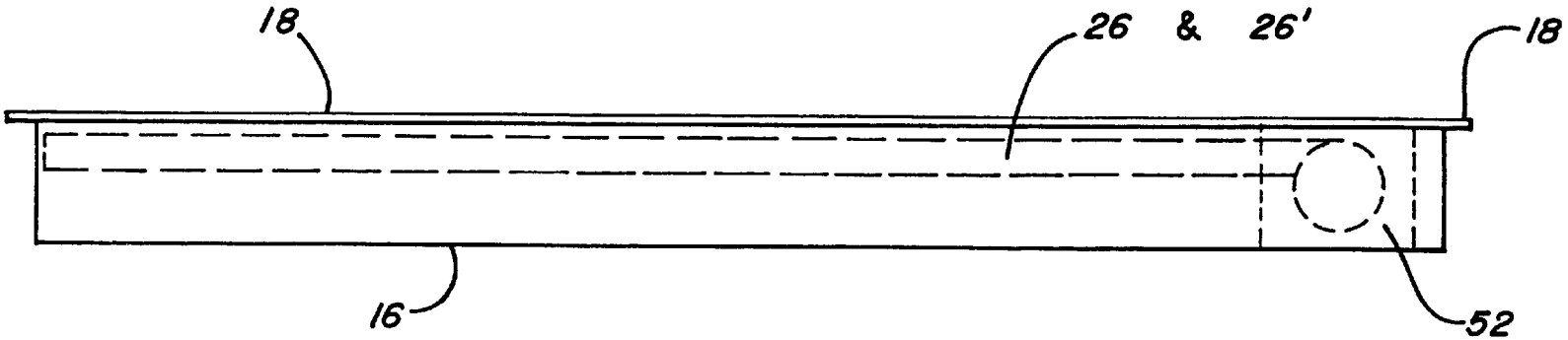
FIG. 7 is a side view of the refrigeration unit of FIG. 6 showing the peripheral lip of the outer channel.

Any number or size of food pans 14 may be used in the refrigerated food pan assembly 10 depending on the specific application. In FIGS. 4 and 6, the duct 54 directs cold air into a plenum 26 with outlet vents 28. In FIGS. 6 and 7, an additional duct 54' is shown to direct cold air into an additional plenum 26' extending along the other side of the channel 16, and with an additional set of outlet vents directing air from the other side of the channel 16.

Further, the warming arrangement 36 may be implemented as a coil 36 in the refrigeration circuit, as an electrical resistive heating element, or as another type of heating element. Accordingly, it is to be further understood that the detailed description and drawings set forth hereinabove are for illustrative purposes only and do not constitute a limitation on the scope of the invention.

What is claimed is:

1. A refrigerated food pan assembly comprising:

an elongated inner channel with inner walls and a base;

an elongated outer channel extending around said inner channel;

refrigeration coils in thermal conduction with said inner channel for cooling the space within said inner channel, said coils being located around the inner walls and a base of the inner channel;

a plurality of food pans mounted into said inner channel, said food pans being spaced apart from one another and from the inner walls of said inner channel;

an elongated cold air plenum extending along said inner channel near the upper portion thereof; said plenum having vent openings for directing cold air between said food pans near the tops thereof;

a fan arrangement for drawing cold air from within said inner channel and for directing said cold air into said plenum; and at least one upper refrigeration coil being mounted at an elevation relative to the upper surface of said pans to provide a relatively stationary blanket of cold air immediately above the upper surface of said pans.

2. An assembly as defined in claim 1 wherein said assembly includes a compression refrigeration system having an expansion valve and including a warming coil for location along the upper edge of said assembly for preventing frost build up, and wherein the warming coil is supplied with refrigerant which has been compressed and which is therefore warm, and which has not passed through the refrigeration system expansion valve.

3. An assembly as defined in claim 1 wherein the upper refrigeration coil is mounted at an elevation slightly above the upper surface of said pans.

4. An assembly as defined in claim 1, wherein said assembly includes two plenums and two sets of vent openings, wherein one plenum and one set of vent openings is located along each elongated side of said channel for cooling larger food pans.

5. An assembly as defined in claim 1 wherein said fan arrangements include inlet vents to receive cold air circulating between the inner channel and the food pans from beneath said food pans.

6. An assembly as defined in claim 1 wherein said food pans mounted into said inner channel are removable for ease in cleaning said pans and said inner channel.

7. A refrigerated food pan assembly comprising:

an elongated inner channel with inner walls and a base;

an elongated outer channel extending around said inner channel;

refrigeration coils in thermal conduction with said inner channel for cooling the space within said inner channel, said coils being located around the inner walls and a base of the inner channel;

a plurality of food pans mounted into said inner channel, said food pans being spaced apart from one another and from the inner walls of said inner channel;

an elongated cold air plenum extending along said inner channel near the upper portion thereof; said plenum having vent openings for directing cold air toward said food pans near the tops thereof; and a fan arrangement for drawing cold air from within said inner channel and for directing said cold air into said plenum.

8. A refrigerated food pan assembly comprising:

an elongated channel with inner walls;

refrigeration coils mounted along the inner walls of said channel for cooling the space within said channel;

a plurality of food pans mounted into said channel, said food pans being spaced apart from one another and from the inner walls of said channel;

at least one elongated cold air plenum extending along said channel near the upper portion thereof; said plenum having vent openings for directing cold air into said channel near the tops of said pans; and fan arrangements for drawing cold air from within said channel and for directing said cold air into said plenum.

9. A refrigerated food pan assembly according to claim 8, wherein said plenum and said vent openings of said plenum are located along one elongated side of said channel.

10. A refrigerated food pan assembly according to claim 8, wherein said assembly includes two plenums and two sets of vent openings, wherein one plenum and one set of vent openings is located along each elongated side of said channel for cooling larger food pans.

11. A refrigerated food pan assembly according to claim 8, wherein said fan arrangements include inlet vents to receive cold air circulating between the food pans from beneath said food pans.

12. A refrigerated food pan assembly according to claim 8, wherein each one of said food pans includes a mounting lip that serves to mount said food pan within said channel and space it from adjacent pans.

13. A refrigerated food pan assembly according to claim 8, wherein said food pans mounted into said channel are removable for ease in cleaning said pans and said channel.

14. A refrigerated food pan assembly comprising:

an elongated channel with inner walls, said channel having an outwardly extending rim or lip;

refrigeration coils mounted along the inner walls of said channel for cooling the space within said channel;

a plurality of food pans mounted into said channel, said food pans being spaced apart from one another and from the inner walls of said channel;

at least one upper refrigeration coil being mounted at an elevation slightly above the upper surface of said pans to provide a relatively stationary blanket of cold air immediately above the upper surface of said pans; and warming arrangements mounted near the top of said channel and spaced outward from said upper refrigeration coil, to prevent build-up of frost on the upper surface of said peripheral rim or lip of said channel.

15. A refrigerated food pan assembly according to claim 14, wherein said warming arrangements employ a sub-cooling warming coil.

16. A refrigerated food pan assembly according to claim 14, wherein said warming arrangements employ an electrical resistive heating element.

17. A refrigerated food pan assembly according to claim 15, wherein said assembly includes a compression refrigeration system having an expansion valve and wherein said warming coil is supplied with refrigerant which has been compressed and which is therefore warm, and which has not passed through the refrigeration system expansion valve.

18. A refrigerated food pan assembly according to claim 17, wherein said warming coil operates in a sub-cooling loop by removing heat from the refrigerant within said refrigeration coils to warm the peripheral lip and rim of said channel without disturbing said stationary blanket of cool air above the upper surface of said food pans.

* * * * *